US005105349A

United States Patent [19]

Falls et al.

[11] Patent Number: 5,105,349

[45] Date of Patent: Apr. 14, 1992

[54] MOTORIZED CHANDELIER LIFT SYSTEM

[76] Inventors: John W. Falls, 2700 Brook Bridge Cove, Germantown, Tenn. 38138; Garry L. Rolen, 1003 Eleanor St., #4, Knoxville, both of Tenn. 37917

[21] Appl. No.: 728,722

[22] Filed: Jul. 11, 1991

Related U.S. Application Data

[63] Continuation-in-part of Ser. No. 587,268, Sep. 24, 1990, abandoned.

[51] Int. Cl.[5] ..... F21S 1/06

[52] U.S. Cl. ..... 362/405; 362/147; 248/329

[58] Field of Search ..... 318/366; 362/418, 430, 362/451, 384, 148, 147, 404, 403, 405, 406, 802, 391; 248/329, 328, 327

[56] References Cited

U.S. PATENT DOCUMENTS

| | | | |
|---|---|---|---|
| 2,351,997 | 6/1944 | Morrill | 318/366 |
| 2,609,170 | 9/1952 | Farrington et al. | 248/319 |
| 3,610,584 | 8/1971 | Pfaff, Jr. | 362/403 |
| 4,195,332 | 3/1980 | Thompson | 362/391 |
| 4,276,500 | 6/1981 | Sumka et al. | 318/366 |
| 4,316,238 | 2/1982 | Booty et al. | 362/147 |
| 4,381,539 | 4/1983 | Sakurai | 362/258 |

OTHER PUBLICATIONS

Benjamin advertisement schedule 17 page F4A-5, Mar. 11, 1938, "Saflox".

*Primary Examiner*—Ira S. Lazarus
*Assistant Examiner*—L. Heyman
*Attorney, Agent, or Firm*—Walker & McKenzie

[57] ABSTRACT

A motorized apparatus to raise and lower a ceiling light fixture, such as a chandelier, to facilitate cleaning and bulb changing. A hoist mechanism, mounted above the ceiling between two joists, includes a drive motor with a drive shaft, and a take-up shaft coupled to the drive shaft, upon which is wound a single hoist cable which raises and lowers the light fixture. A ceiling junction box includes a first set of contacts for supplying electricity to the light fixture when the light fixture is raised, and one or more switches for preventing the light fixture from being hoisted past the raised position and for removing power from the first set of contacts when the light fixture is lowered. A canopy junction box, attached to the light fixture, includes a second set of contacts for receiving electricity from the first set of contacts. When the light fixture is raised, a ceiling canopy protects the first and second set of contacts from access. The take-up shaft may be part of a winch, and either the motor or the winch may have a brake for preventing the light fixture from falling. Either a wall switch or a remote control device may control the operation of the motor.

30 Claims, 9 Drawing Sheets

FIG. 1
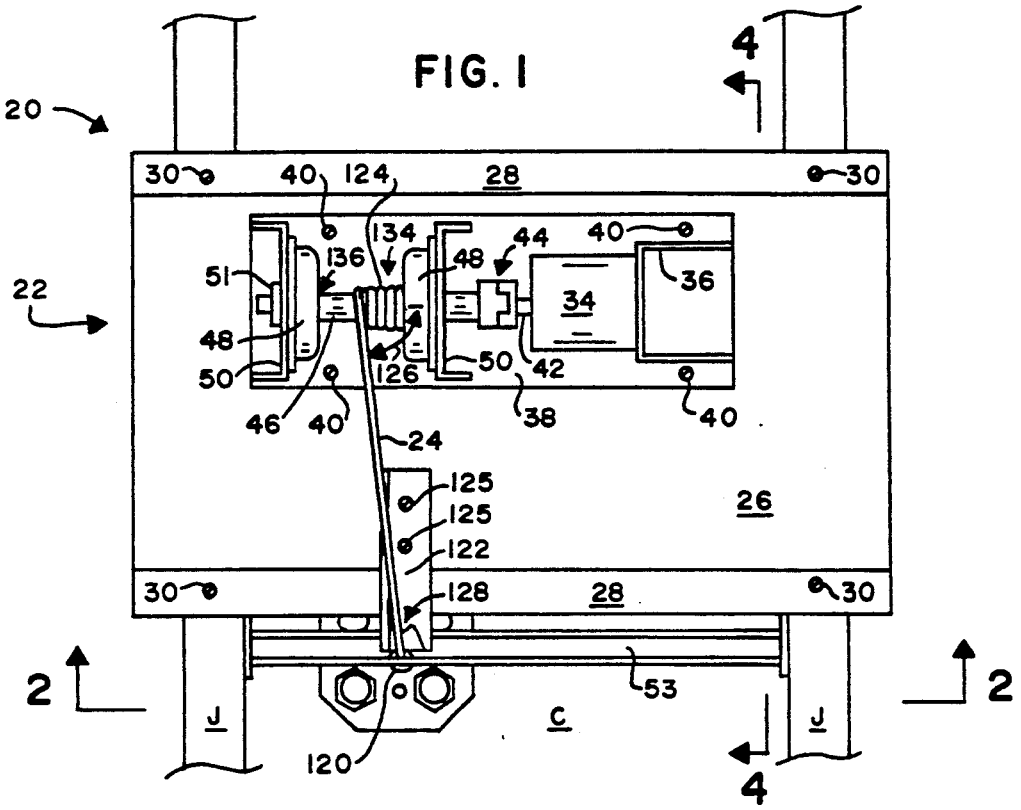
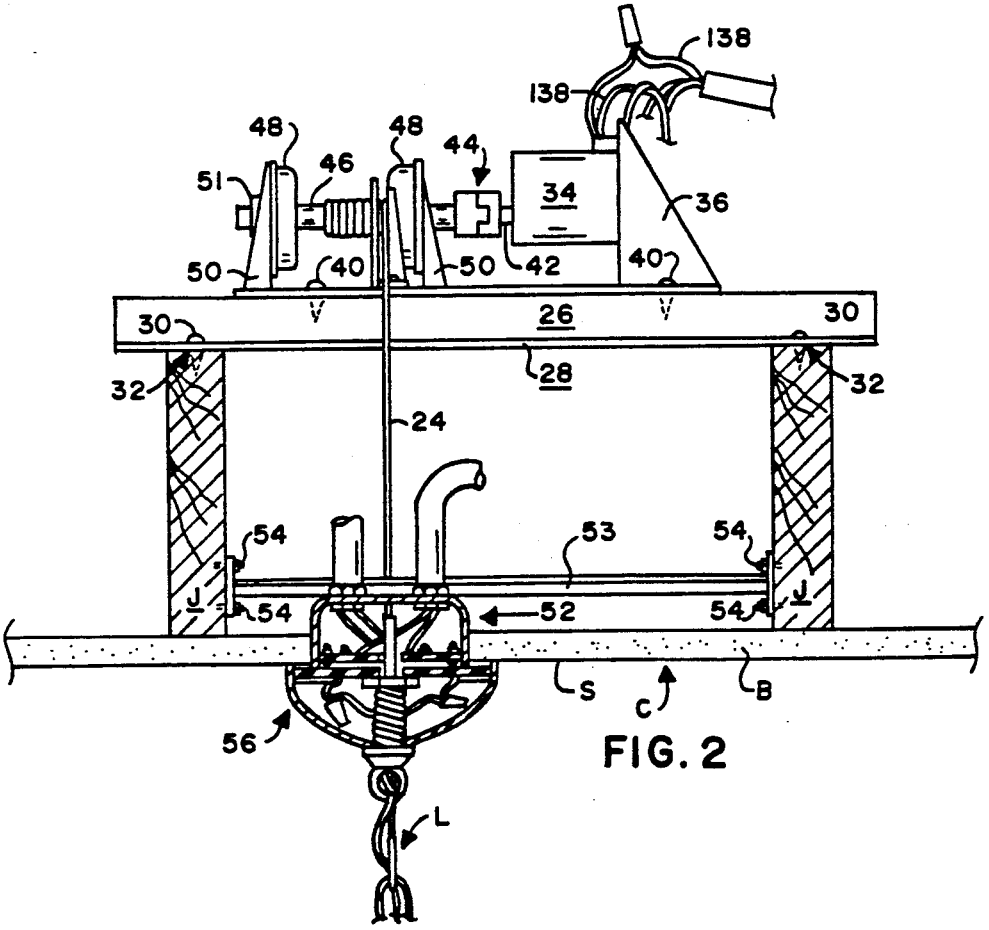
FIG. 2

MOTORIZED CHANDELIER LIFT SYSTEM

CROSS-REFERENCE TO RELATED APPLICATION

This is a continuation-in-part of my application, Ser. No. 07/587,268, filed Sept. 24, 1990, now abandoned, entitled "Motorized Chandelier Lift System."

BACKGROUND OF THE INVENTION

1. Field of the Invention

The present invention relates, in general, to devices for raising and lowering light fixtures, and in particular, to an electrically motorized apparatus to raise and lower chandelier light fixtures to facilitate cleaning and changing of bulbs.

2. Information Disclosure Statement

A preliminary patentability search in class 362, subclasses 147, 384, 404, 391, 418, and 403, produced the following patents, some of which may be relevant to the present invention: Farrington et al., U.S. Pat. No. 2,609,170, issued Sept. 2, 1952; Pfaff, U.S. Pat. No. 3,610,584, issued Oct. 5, 1971; Booty et al., U.S. Pat. No. 4,316,238, issued Feb. 16, 1982; and Sakurai, U.S. Pat. No. 4,381,539, issued Apr. 26, 1983. Additionally, during prosecution of the predecessor of this application, an advertisement of a floodlight lowering attachment, dated Mar. 11, 1938, manufactured and sold by the Benjamin Company under the name "SAFLOX", was cited by the Examiner. While each of the above references disclose various apparatus for raising and lowering light fixtures, none disclose or suggest the present invention. More specifically, none of the above patents disclose or suggest a motorized light fixture lift system, comprising: a hoist mechanism for raising and lowering a light fixture between a raised position adjacent a ceiling and a lowered position distant from the ceiling, said hoist mechanism comprising: a drive motor including a drive shaft, and a take-up shaft coupled to the drive shaft; a ceiling junction box including a first set of contacts for supplying a source of electrical power to the light fixture; a canopy junction box attached to the light fixture comprising a second set of contacts mounted for receipt of electricity from the first set of contacts when the light fixture is in the raised position; and, a single hoist cable attached at one end to the take-up shaft for being wound upon said take-up shaft and attached at the other end to the canopy junction box.

Farrington et al., U.S. Pat. No. 2,609,170, describes a motor driven lamp hanger with multiple embodiments. The Farrington device, as described, has four cables supporting the lamp fixture which are wound on four separate drums. The Farrington patent also describes upper and lower limit switches to shut off the power to the drive motor at the extremes of travel of the lamp fixture, as well as fixed and mating contacts to supply power to the lamp fixture when in the raised position. The present invention has only a single cable supporting the light fixture, not a multiplicity as in the Farrington device.

Pfaff, U.S. Pat. No. 3,610,584, describes a lowering mechanism for a light fixture which comprises a drive motor and braking mechanism, said drive motor being coupled through a chain drive mechanism to a take-up shaft comprising a pair of drums, each of which winds a flexible ribbon or tape which is attached to the light fixture. The present invention has only a single cable supporting the light fixture, not a multiplicity of ribbons or tapes as in the Pfaff device, and uses no chain drive mechanism to couple the take-up shaft to the drive motor.

Booty et al., U.S. Pat. No. 4,316,238, describes a light fixture and elevator therefor, comprising a horizontally reciprocal carriage, a biasing spring attached to the carriage, said carriage moving horizontally as the light fixture is raised and lowered. A hydraulic piston may be attached to the carriage of the Booty device for controlling the rate of movement of the carriage, and therefore the descent rate of the light fixture. Unlike the present invention, the Booty device is manually operated and is not motorized, and has no contacts which interrupt the flow of electricity to the light fixture when the light fixture is not in the raised position. Also, the present invention has no such horizontally reciprocal carriage or biasing spring.

Sakurai, U.S. Pat. No. 4,381,539, describes a non-motorized height level adjusting means for a light fixture comprising a string winder with ratchets which wind a plural number of strings or wires, attached to the light fixture, onto a plural number of spools. Unlike the Sakurai patent, which is manually operated, the present invention is motorized and has only a single hoist cable attached to the light fixture. Also, the Sakurai patent, like the Booty device, has no contacts which interrupt the flow of electricity to the light fixture when the light fixture is not in the raised position.

The advertisement for the Benjamin "SAFLOX" floodlight lowering attachment shows a hand operated mechanism that raises and lowers an outdoor floodlight. The mechanism includes two sets of contacts that meet and are protected when the lamp is in the raised position, but is not motorized as is the present invention.

SUMMARY OF THE INVENTION

Ceiling-mounted light fixtures, such as chandeliers and other similar devices, often have to be periodically accessed for cleaning, service, repair, and the replacement of bulbs. Rather than requiring someone to climb on a ladder to accomplish this access of the light fixture, it is desirable to provide a motorized mechanism for lowering the light fixture for access by one standing on the floor below. Previous mechanisms for this purpose have been intricate and complex, some using chain drive mechanisms and a multiplicity of support or hoist cables.

It is an object of the present invention to provide a motorized light fixture lift system for raising and lowering a light fixture between a raised position adjacent a ceiling and a lowered position distant from the ceiling, including a single hoist cable which is wound on a take-up shaft coupled to a drive motor, said lift system being simple and relatively inexpensive to manufacture.

It is a further object of the present invention to provide contact means for supplying electrical power to the light fixture when the light fixture is in the raised position, safety means for removing electrical power from the contact means when the light fixture is not in the raised position, as well as means for covering the contact means from access when the light fixture is in the raised position.

Also, it is an object of the present invention to provide limit means which interrupt the flow of power to the drive motor as the light fixture enters the raised position, preventing damage to the lift system, ceiling, or light fixture that might occur were an attempt made to raise the light fixture past the raised position. Furthermore, it is an object of the present invention to provide means for securing the light fixture from falling from the ceiling, and also for providing wireless remote control means for operating the lift system.

BRIEF DESCRIPTION OF THE DRAWINGS

FIG. 1 is a top plan view of the first embodiment of the present invention, shown mounted on top of a pair of ceiling joists.

FIG. 2 is a front elevational view of the first embodiment, taken substantially along the lines 2—2 shown in FIG. 1.

DESCRIPTION OF THE PREFERRED EMBODIMENT

Figure 3:
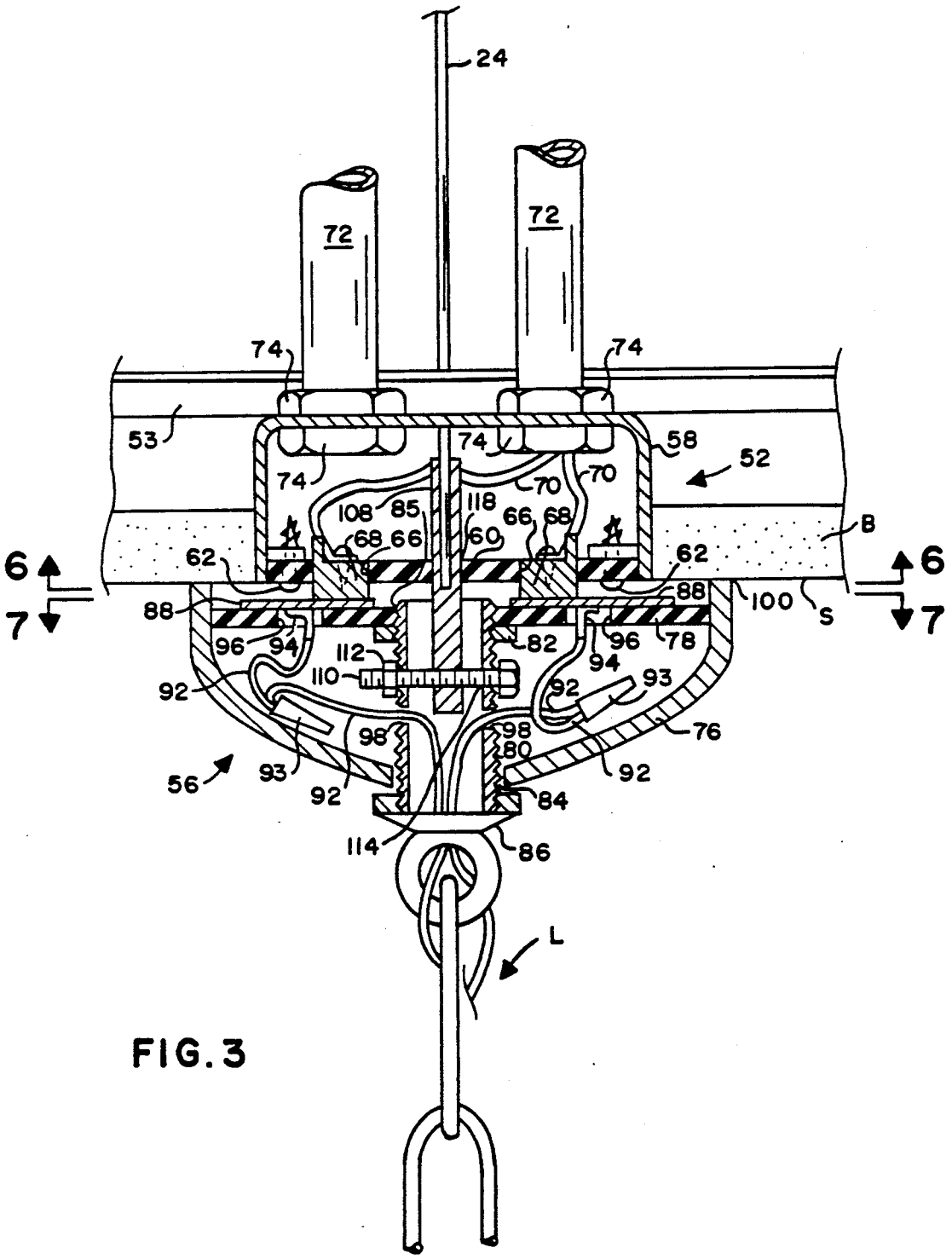
FIG. 3 is a detail of a portion of FIG. 2, showing the ceiling junction box and canopy junction box of the first embodiment.

Referring to FIG. 1, a first embodiment of the motorized light fixture lift system 20 is seen to comprise a hoist mechanism 22 for raising and lowering a chandelier or ceiling light fixture L, partially shown in FIGS. 2 and 3, and a single hoist wire or cable 24. Hoist mechanism 22 is seen to include a base 26 for mounting above a ceiling C. Base 26, preferably constructed from sheet metal, may include mounting flanges 28 for attachment to spaced apart ceiling joists J such as by nails or screws 30, passing through holes or slots 32, shown in FIGS. 2 and 4, in flanges 28. Additional holes or slots, not shown, may be provided in mounting flanges 28 for accommodating the various joist spacings that may be typically encountered, and base 26 is preferably oversized so as to easily span the larger joist spacings as required.

Figure 4:
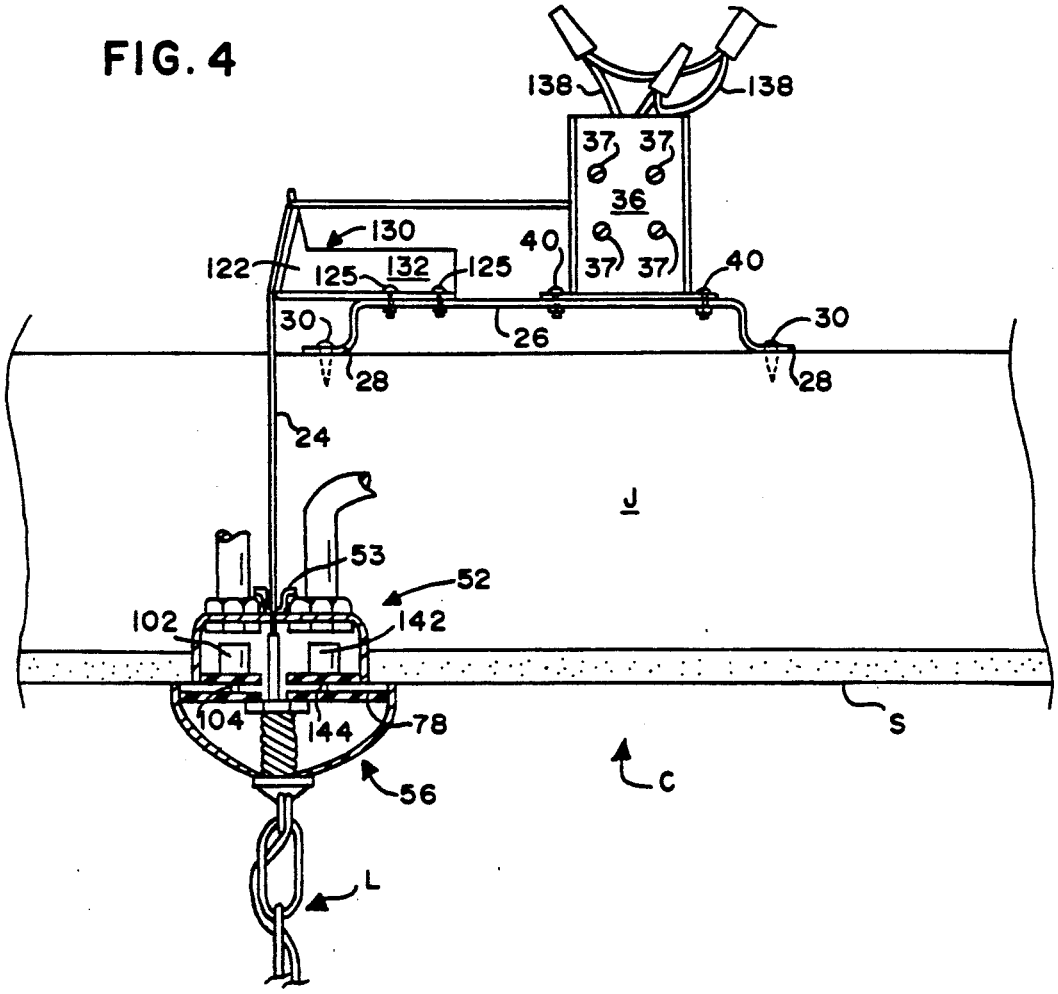
FIG. 4 is a right side elevational view of the first embodiment, taken substantially along the lines 4—4 shown in FIG. 1.

Hoist mechanism 22 also is seen to include a drive motor 34, preferably a reversible synchronous drive motor as shown, mounted upon base 26, preferably using screws 37, shown in FIG. 4, securing drive motor 34 to mounting bracket 36 attached to mounting plate 38 of base 26. Mounting plate 38 may be welded to base 26 or attached by other means such as screws 40 as shown. Drive motor 34 includes a drive shaft 42 directly coupled through a coupling 44, preferably a flexible coupling and spider as shown in FIG. 1, well known to those skilled in the art, to take-up shaft 46. Take-up shaft 46 is supported by bearings 48, preferably self-aligning bronze bearings, mounted upon support brackets 50, which may be made of sheet metal, and may be secured by shaft collar 51 as shown.

Referring to FIGS. 1, 2, 3, and 4, lift system 20 also is seen to comprise a ceiling junction box 52, mounted a fixed distance from base 26, preferably mounted substantially flush with lower ceiling surface S of ceiling tile or gypsum board B attached to joists J. Ceiling junction box 52 is typically mounted to the ceiling using a "U"-shaped support bracket 53, well known to those skilled in the art, attached to joists J using nails or screws 54 and spanning the distance between joists J as shown. Lift system 20 is also seen to include a canopy junction box 56, shown in FIGS. 2, 3, and 4, attached to light fixture L.

Figure 6:
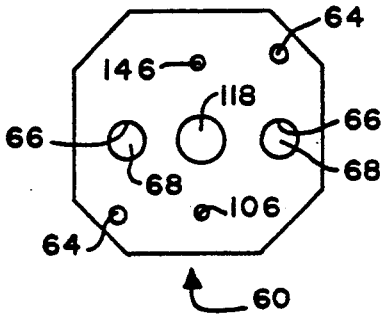
FIG. 6 is a bottom view, looking upward, of the ceiling junction box cover plate of the first embodiment, taken substantially along the lines 6—6 shown in FIG. 3.

Referring to FIG. 3, the details of ceiling junction box 52 and canopy junction box 56 can be seen. Ceiling junction box 52 includes a body 58, preferably a well known electrical junction box as shown, and a ceiling junction box cover plate 60, secured to body 58 by screws 62 passing through holes 64 (shown in FIG. 6). Cover plate 60, constructed of a suitably strong non-conductor material, includes holes 66 in which are mounted a first set of contacts 68 for supplying a source of electrical power, through wires 70 connected to a usual power source, not shown. Wires 70 may be attached to contacts 68 using screw terminals or clips, well known to those skilled in the art. Typically, wires 70 will pass through conduit 72 anchored to ceiling junction box 52 using nuts 74.

Figure 7:
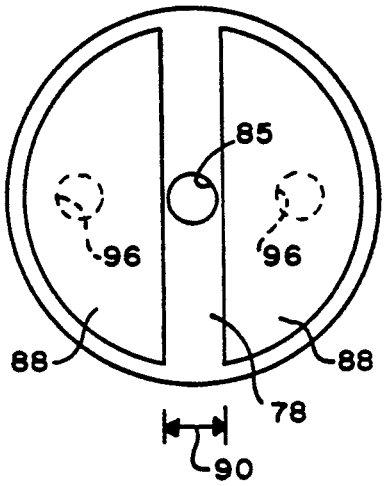
FIG. 7 is a top view, looking downward, of the canopy junction box cover plate of the first embodiment, taken substantially along the lines 7—7 shown in FIG. 3.

Canopy junction box 56 is seen to preferably comprise a canopy cover 76, canopy junction box cover plate 78, and threaded sleeve 80. In the preferred first embodiment, cover plate 78 has a hex nut 82 securely attached to the underside thereof, securing cover plate 78 to threaded sleeve 80, which passes through hole 84 in canopy cover 76 and is then secured to canopy cover 76 by threaded hanger 86, which supports lighting fixture L, partially shown. Cover plate 78 is seen to have a hole 85 in substantial alignment with hex nut 82, providing clearance for sleeve 80. Cover plate 78, constructed of a suitably strong non-conductor material, has a second set of contacts, preferably semi-circular plates 88 also shown in FIG. 7, laminated to the upper surface thereof as shown, mounted for receipt of electricity from the first set of contacts when the light fixture is in the raised position, adjacent the ceiling. Together, the first set and second set of contacts, 68 and 88, are seen to comprise contact means for supplying electrical power to the light fixture when the light fixture is in the raised position. The spacing 90 between plates 88 is preferably greater than the width of first set of contacts 68 so that plates 88 are not susceptible to being shorted together by first set of contacts 68 for certain orientations of canopy junction box 56 with respect to ceiling junction box 52, as will now be apparent. Wires 92, possibly joined by wire nuts 93, attach to plates 88 preferably by means of terminals or clips 94 which pass through holes 96 in cover plate 78. Wires 92 also pass through holes 98 in threaded sleeve 80 and through a hole, not shown, in threaded hanger 86, and attach to lamps, not shown, in light fixture L, in the usual manner. Preferably, either or both of first set of contacts 68 or second set of contacts 88 are magnetized for attraction to each other when the light fixture is in the raised position, adjacent the ceiling, to ensure secure and positive connection between the two sets of contacts In the preferred first embodiment, shown in FIG. 3, means are provided, such as peripheral edge 100 of canopy cover 76, extending toward ceiling surface S, for covering contact means, such as first and second set of contacts 68 and 88, from substantial access when the light fixture is in the raised position as shown in FIG. 3, as now understood by those skilled in the art.

Referring to FIG. 4, ceiling junction box 52 may additionally comprise safety switch means, preferably such as normally open plunger type switch 102, wired in series, in a manner well known to those skilled in the art, between first set of contacts 68 and the source of electrical power, not shown, which supplies electricity to contacts 68. Plunger switch 102 is positioned with actuating plunger 104 extending downwardly through hole 106 in ceiling junction box cover plate 60, shown in FIG. 6, in a manner so that, as light fixture L enters the raised position, plunger 104 is urged upwardly, closing the circuit within plunger switch 102 and thereby connecting first set of contacts 68 to the source of electrical power, in a manner well known to those skilled in the art. Conversely, as light fixture L leaves the raised position, the flow of electricity from the source of electrical power to first set of contacts 68 is interrupted as plunger switch 102 assumes the normally open condition when plunger 104 is allowed to proceed downwardly, in a manner now apparent to those skilled in the art. In this manner, when light fixture L is not in the raised position, and contacts 68 are exposed for access, electrical power is removed from contacts 68, providing greater safety to a maintenance worker. Obviously, other appropriate safety switch means could be similarly provided to remove power from contacts 68 when they are exposed for access, in a manner that will now be apparent to those skilled in the art, without departing from the scope of the present invention.

Figure 9:
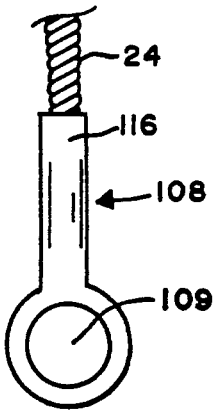
FIG. 9 is a view of the end of the first embodiment hoist cable, showing the attachment of the anchor.

Referring to FIG. 3, hoist cable 24 is seen to allow raising and lowering of light fixture L, preferably by attachment to canopy junction box 56 by attachment means such as anchor 108, shown from another view in FIG. 9, secured to threaded sleeve 80 by securing means such as a cotter pin or preferably a nut 112 and bolt 110 inserted through hole 114 drilled transversely through threaded sleeve 80, and also inserted through opening 109 formed within anchor 108. Hoist cable 24 is securely fastened to anchor 108 by means well known to those skilled in the art, such as by being crimped within a sleeve of anchor 108 or preferably by being welded to or within a sleeve portion 116 of anchor 108.

Figure 5:
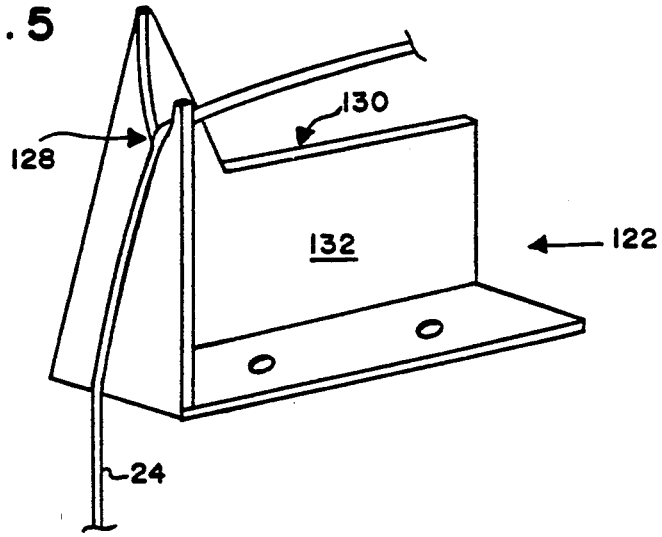
FIG. 5 is a perspective view of the cable guide of the first embodiment.

Hoist cable 24 and anchor 108 are seen to pass through hole 118 of ceiling junction box cover plate 60, with hoist cable 24 continuing to pass through hole 120 in ceiling junction box 52, between joists J, then, guided by cable guide 122, passing to take-up shaft 46 of hoist mechanism 22, where it is secured for winding into windings 124 which are constrained, such as by bearings 48, to lie within the region of take-up shaft 46 defined by portion 134 of take-up shaft 46, toward motor 34, and that defined by portion 136 of take-up shaft 46, remote from motor 34. Referring to FIG. 1, cable guide 122, preferably attached to base 26 using means well known to those skilled in the art, such as screws 125, applies tension to hoist cable 24 as it winds onto take-up shaft 46, urging windings 124 to be biased toward one end of shaft 46 by preferably guiding hoist cable 24 at an angle 126, preferably not more than ninety degrees, with respect to take-up shaft 46. In the preferred first embodiment, as shown in FIG. 5, cable guide 122 has a notch 128, preferably "U" shaped as shown, for receiving hoist cable 24, as well as a cutaway portion 130 in flange 132 for avoidance of hoist cable 24. If desired, a pulley (not shown) may be provided on cable guide 122, in a manner well known to those skilled in the art, to reduce the frictional forces that might be present where notch 128 receives hoist cable 24; this pulley would perform substantially the same function as notch 128, with less friction upon cable 24. It will be apparent to those skilled in the art that in order for angle 126 to be not more than ninety degrees, as desired by the present invention, notch 128 shown in FIG. 1 should be located outside, or on the boundary of, the region defined at one end by a first extended radius of shaft 46 at portion 134 thereof, and at the other end by a second extended radius of shaft 46 at portion 136 thereof (i.e., the extremes of the available winding area on shaft 46). When notch 128 is so located, cable guide 122, guiding hoist cable 24 at angle 126 with respect to take-up shaft 46, urges windings 124 to be biased toward one end of take-up shaft 46. Were angle 126 to be greater than ninety degrees, as if, for instance, were cable guide 122 to be positioned midway between the first and second extended radii described above, windings 124 of hoist cable 24 would not be urged toward one end of take-up shaft 46 as they are using the preferred orientation, since angle 126 would range from less than ninety degrees to greater than ninety degrees as cable 24 winds onto take-up shaft 46. As hoist cable 24 winds and unwinds on take-up shaft 46, light fixture L is raised and lowered, traveling from a raised position adjacent ceiling C, as shown in FIGS. 2 through 4, to a lowered position, not shown, distant from the ceiling, for cleaning, maintenance, and changing of bulbs.

It should be understood that an existing ceiling junction box may be adapted for use with the present invention, as ceiling junction box cover plate 60 is preferably sized for attachment to such a standard ceiling junction box, and that a commercially available canopy cover (and threaded sleeve therein), which typically may be used with a lighting fixture, may be adapted and reworked in accordance with this specification and FIG. 3, by drilling holes 114 and 98 within sleeve 80, thus saving cost to the installer of the motorized chandelier lift system.

Figure 8:
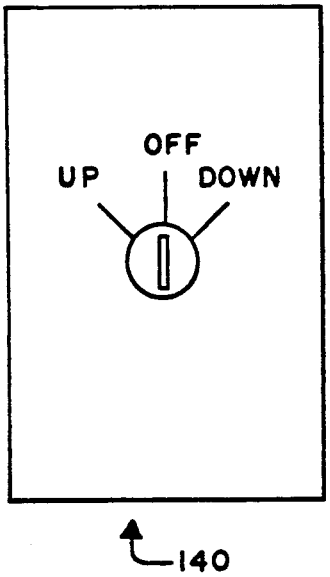
FIG. 8 is a view of the wall box key switch which controls the present invention.

Motor 34 is supplied power through wires 138 attached to a power source, not shown, and is wired, in a manner well known to those skilled in the art, to a control switch, such as wall box key switch 140, shown in FIG. 8. Key switch 140 preferably has three positions, up, off, and down, which cause motor 34 to wind and unwind cable 24 as desired. In the preferred first embodiment, the lift system also comprises limit means which interrupt the flow of power to the drive motor as the light fixture enters the raised position, preventing damage to the lift system, ceiling, or light fixture that might occur were an attempt made to raise the light fixture past the raised position, such as normally closed plunger type limit switch 142, interposed between drive motor 34 and its power source and wired in a manner well known to those skilled in the art. Limit switch 142, shown in FIG. 4, is positioned for interruption of the flow of power to the drive motor as the light fixture enters the raised position, preferably with actuating plunger 144 of limit switch 142 extending downwardly through hole 146 in ceiling junction box cover plate 60, shown in FIG. 6, for contact with canopy junction box cover plate 78 as light fixture L enters the raised position, urging plunger 144 upwardly, opening the circuit within limit switch 142, and thus interrupting power to drive motor 34. It should be understood that alignment marks (not shown) may be provided on canopy cover 76 and ceiling surface S to indicate when contacts 68 are in optimal rotational alignment with plates 88, allowing light fixture L to be rotated, if necessary, for proper mating between contacts 68 and plates 88.

In practice, a maintenance worker would operate wall box key switch 140, causing motor 34 to lower light fixture L for maintenance. As light fixture L leaves the raised position, plunger switch 102 removes power from first set of contacts 68 as they become exposed for access, the light fixture descends further to a lowered position distant from the ceiling, allowing maintenance, and the key switch is returned to the "off" position. After maintenance is completed, key switch 140 is placed in the "up" position, causing motor 34 to raise light fixture L toward the ceiling. As light fixture L enters the raised position, plunger switch 102 is actuated, restoring power to first set of contacts 68, which are magnetically attracted to the second set of contacts, such as plates 88, restoring electricity to light fixture L. Also, as light fixture L enters the raised position, limit switch 142 is actuated, interrupting the flow of power to drive motor 34, preventing light fixture L from being raised past the raised position adjacent the ceiling. Light fixture L will remain in the raised position until key switch 140 is again turned to the "down" position, repeating the lowering process.

For adaptability to ceilings of various heights, cable 24 may be provided with excess length, sufficient to lower light fixture L for access. As a part of the installation process it will be understood that cable 24 may be cut to an appropriate length, preferably extending from hoist mechanism 22 to three feet from the floor, and then attached to take-up shaft 46 in any manner well known to those skilled in the art. Adjustment of cable 24 to such an appropriate length will prevent light fixture L from being damaged by inadvertent contact with the floor, as might otherwise happen if an inattentive maintenance worker left wall box key switch 140 in the "down" position and if cable 24 were excessively long. It will now be apparent that if the length of cable 24 is chosen so that light fixture L cannot inadvertently contact the floor, hoist mechanism 22, after lowering light fixture L to the fully lowered position, will then begin to raise the light fixture back toward the ceiling as take-up shaft 46 continues rotating.

A second embodiment of the motorized light fixture lift system is shown in FIGS. 10–22, with identifying reference designators marked similarly to the first embodiment, except with the prefix "2.".

Figure 10:
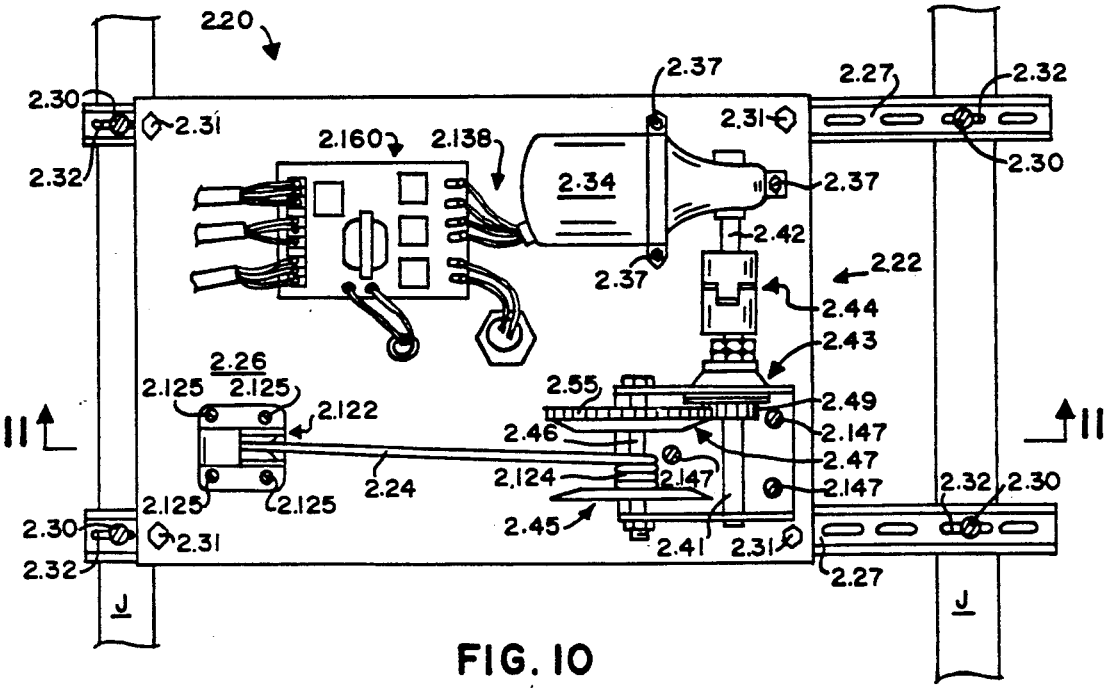
FIG. 10 is a top plan view of the second embodiment of the present invention, shown mounted on top of a pair of ceiling joists.
Figure 11:
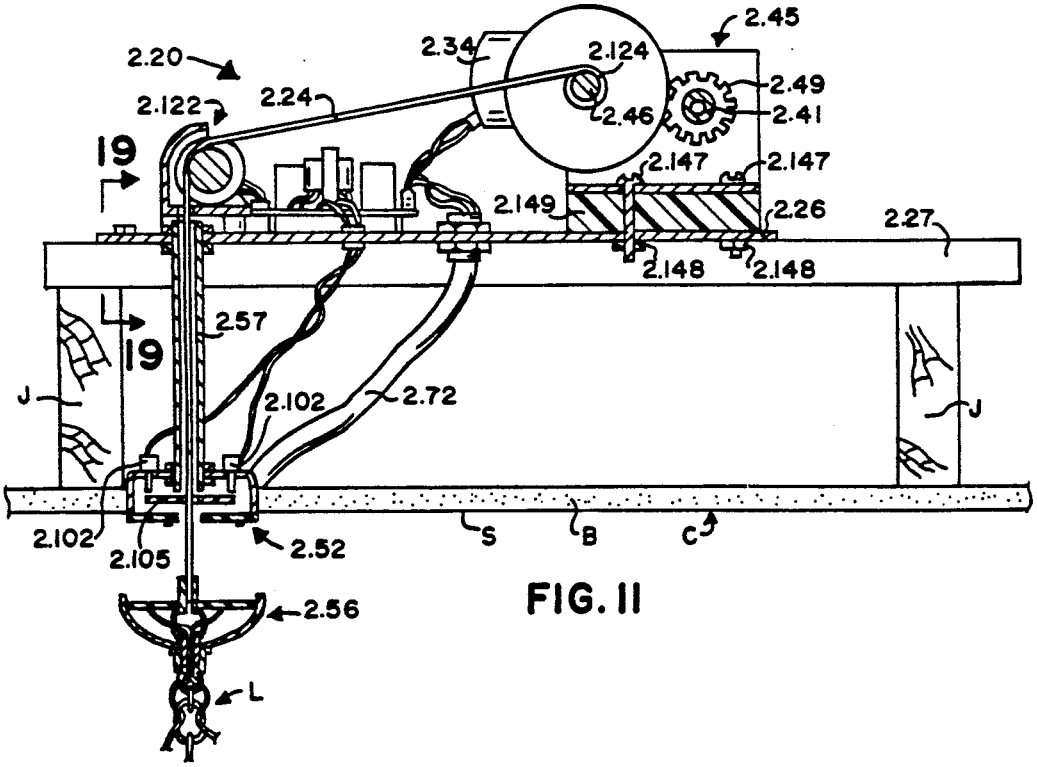
FIG. 11 is a front sectional view of the second embodiment, taken substantially along the lines 11—11 shown in FIG. 10.
Figure 12:
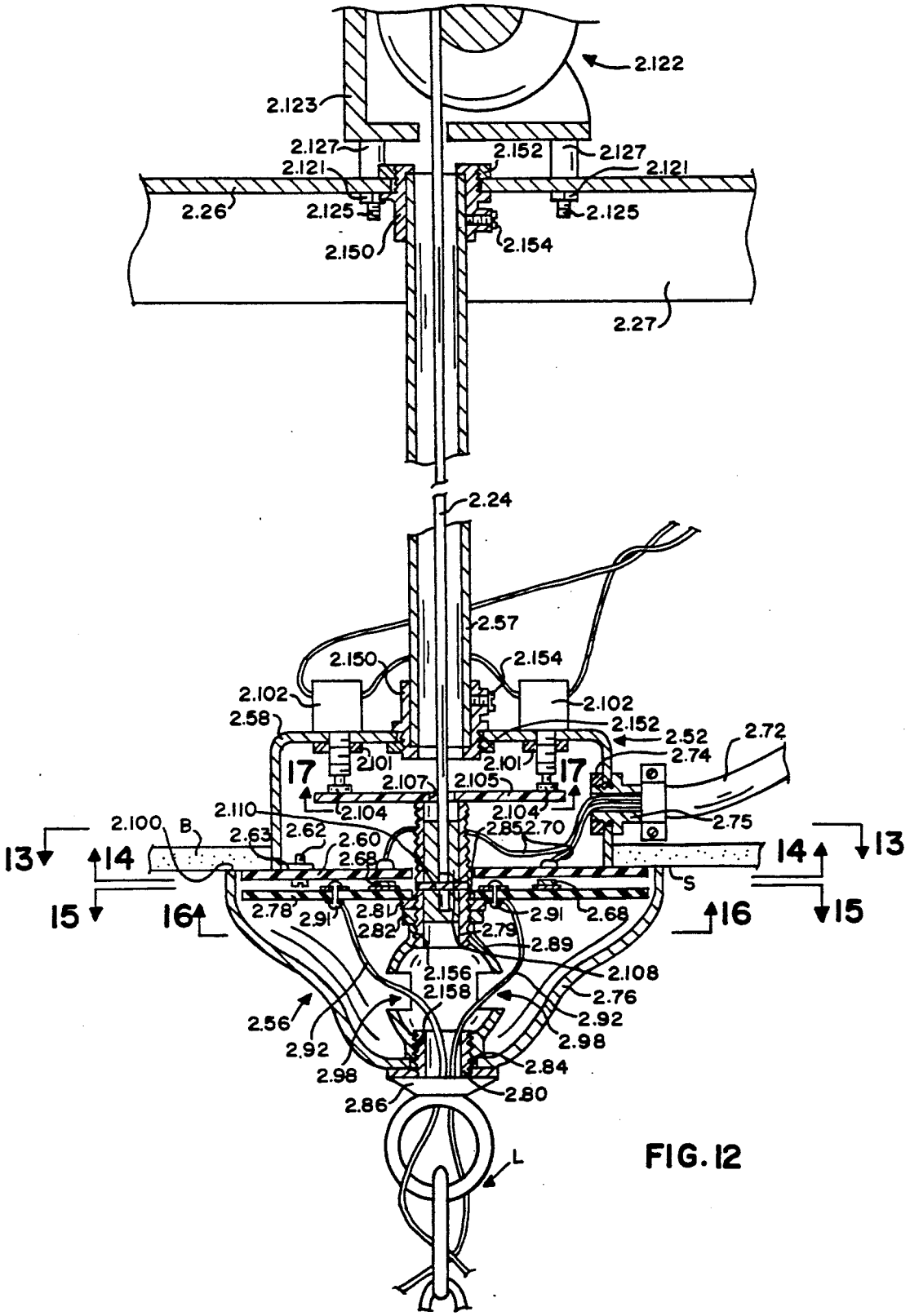
FIG. 12 is a detail of a portion of FIG. 11, showing the canopy junction box as well as the ceiling junction box and its mounting, for the second embodiment.
Figure 13:
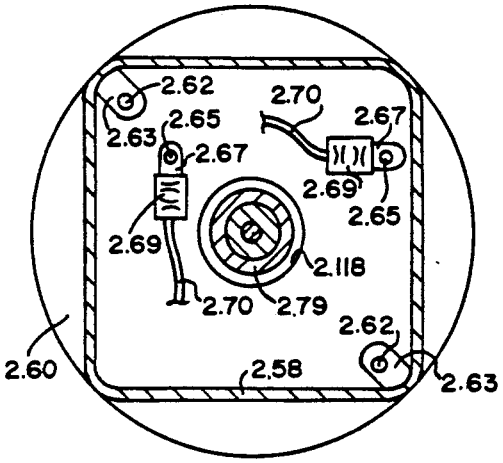
FIG. 13 is a top sectional view of the ceiling junction box of the second embodiment, taken substantially along the lines 13—13 shown in FIG. 12.
Figure 14:
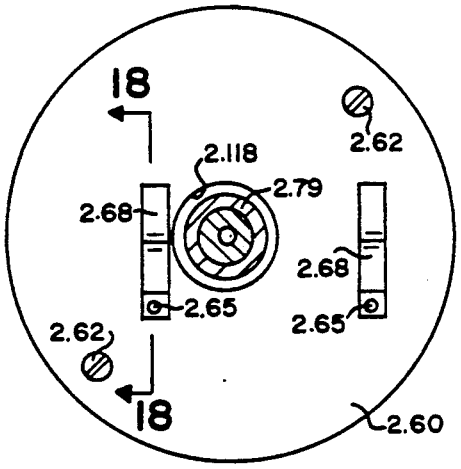
FIG. 14 is a bottom view, looking upward, of the ceiling junction box cover plate of the second embodiment, taken substantially along the lines 14—14 shown in FIG. 12.

Referring to FIG. 10, a second embodiment of the motorized light fixture lift system 2.20 is seen to comprise a hoist mechanism 2.22 for raising and lowering a chandelier or ceiling light fixture L, partially shown in FIGS. 11 and 12, and a single hoist wire or cable 2.24. Hoist mechanism 2.22 is seen to include a base 2.26 for mounting above a ceiling C. Base 2.26, preferably constructed from sheet metal, mounts on rails 2.27 spanning spaced apart ceiling joists J. Rails 2.27 are attached to joists J by securing means such as by nails or screws 2.30, passing through a selected set of holes or slots 2.32 in rails 2.27 and chosen to match the spacing between the joists J. Base 2.26 may be adjustably mounted on rails 2.27 using base positioning means 2.29 shown in FIG. 19, preferably comprising a bolt 2.31, a nut 2.33, and a washer 2.35 adjustably securing base 2.26 to inwardly extending lips 2.25 of rails 2.27 in a manner that will now be apparent, thereby allowing base 2.26 to be positioned between joists J as required Hoist mechanism 2.22 also is seen to include a drive motor 2.34, preferably a reversible synchronous drive motor as shown, mounted upon base 2.26, preferably using screws 2.37. In this second preferred embodiment, motor 2.34 may be a right-angle shaft gearmotor, such as the Model V3-65 right-angle shaft gearmotor, manufactured by Von Weis Gear Company, St. Louis, Mo., allowing compact placement of motor 2.34 on base 2.26 as shown in FIG. 10. Drive motor 2.34 includes a drive shaft 2.42 coupled through a coupling 2.44, preferably a flexible coupling and spider as shown in FIG. 10, well known to those skilled in the art, to take-up shaft 2.46. Preferably, take-up shaft 2.46 constitutes part of a winch means 2.45 for winding and unwinding cable 2.24. Winch means 2.45 may have gear means 2.47, comprising gears 2.49 and 2.55, rotatably coupling input shaft 2.41 to take-up shaft 2.46. Preferably, winch means 2.45 also comprises self-activating automatic braking means 2.43, well-known to those skilled in the art, for preventing cable 2.24 from unwinding except as caused by the rotation of drive shaft 2.42. A suitable winch having gears and a self-activating automatic braking means is the Model K1051 winch, manufactured by Fulton Performance Products, P. O. Box 19903, Milwaukee, Wis. 53219. Braking means 2.43 prevents the load, i.e., light fixture L, from falling if, for instance, coupling 2.44 were to become loosened on shaft 2.42 or shaft 2.41. Winch means 2.45 also may mount to base 2.26 using screws 2.147 and nuts 2.148, passing through spacer block 2.149 chosen in thickness to place shafts 2.41 and 2.42 in substantial alignment. It shall be understood, however, that, by appropriate arrangement of parts on base 2.26, drive shaft 2.42 could be coupled to take-up shaft 2.46 as in the first preferred embodiment, without using a right-angle drive gearmotor 2.34, and instead using a motor whose shaft is coaxially aligned with take-up shaft 2.46, omitting gear means 2.47 and shaft 2.41, without departing from the spirit and scope of the second preferred embodiment.

Referring to FIGS. 11–14, lift system 2.20 also is seen to comprise a ceiling junction box 2.52, preferably mounted substantially flush with lower ceiling surface S of ceiling tile or gypsum board B attached to joists J. Ceiling junction box 2.52 is seen to be mounted a fixed distance from base 2.26, attached to one end of a conduit tube 2.57, whose other end is attached to base 2.26. Tube 2.57, attached at either end to base 2.26 and ceiling junction box 2.52 by well-known electrical conduit connectors 2.150, nuts 2.152, and set screws 2.154, see FIG. 12, is selected for a length, when base 2.26 is mounted above joists J on rails 2.27, that will cause ceiling junction box 2.52 to be substantially flush with ceiling surface S. For instance, if joists J are well-known "2×6" beams, tube 2.57 will typically be 5 5/16 inches long. Similarly, if joists J are well-known "2×10" beams, tube 2.57 necessarily will be longer, typically 9 1/16 inches long.

Lift system 2.20 is also seen to include a canopy junction box 2.56, shown in FIGS. 11, 12, 15, and 16, attached to light fixture L.

Referring to FIG. 12, the details of ceiling junction box 2.52 and canopy junction box 2.56 can be seen. Ceiling junction box 2.52 includes a body 2.58, preferably a well known electrical junction box as shown, and a ceiling junction box cover plate 2.60, secured to body 2.58 by screws 2.62 passing through holes in tabs 2.63 (shown in FIGS. 12 and 13). Cover plate 2.60, see FIGS. 12–14 and 18, constructed of a suitably strong non-conductor material, includes screws or rivets 2.65 which attach a first set of contacts 2.68 for supplying a source of electrical power to terminals 2.67, through wires 2.70 connected to a power source, in a manner hereinafter described. Wires 2.70 may be attached to terminals 2.67 using screws or preferably slide-on clip fasteners, well known to those skilled in the art, such as fasteners 2.69. Typically, wires 2.70 will pass through conduit 2.72 which is anchored to ceiling junction box 2.52 using nut 2.74 on feedthrough 2.75.

Figure 15:
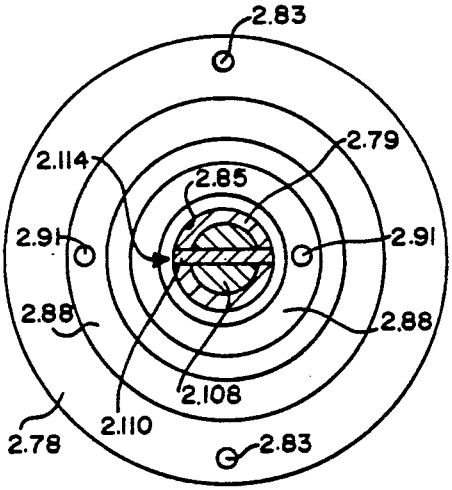
FIG. 15 is a top view, looking downward, of the canopy junction box cover plate of the second embodiment, taken substantially along the lines 15—15 shown in FIG. 12.
Figure 16:
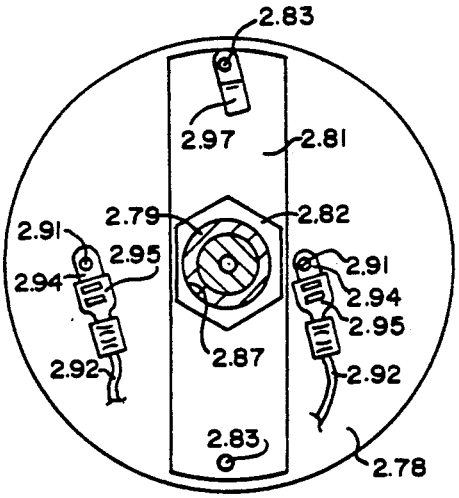
FIG. 16 is a bottom view, looking upward, of the canopy junction box cover plate of the second embodiment, taken substantially along the lines 16—16 shown in FIG. 12.
Figure 17:
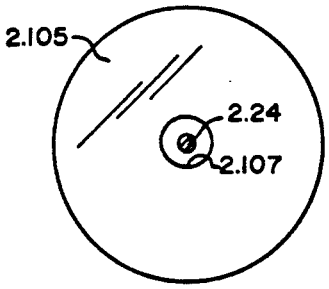
FIG. 17 is a bottom view, looking upward, of the canopy junction box actuating plate of the second embodiment, taken substantially along the lines 17—17 shown in FIG. 12.
Figure 18:
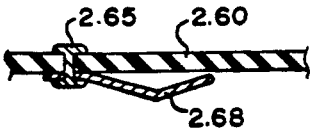
FIG. 18 is a sectional view of a contact on the ceiling junction box cover plate of the second embodiment, taken substantially along the lines 18—18 shown in FIG. 14.
Figure 19:
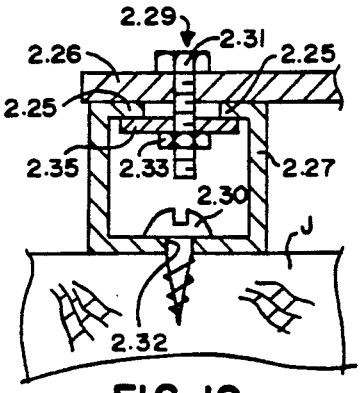
FIG. 19 is a sectional view of the base positioning means of the second embodiment, taken substantially along the lines 19—19 shown in FIG. 11.

Referring to FIGS. 12, 15, and 16, canopy junction box 2.56 is seen to preferably comprise a canopy cover 2.76, canopy junction box cover plate 2.78, and first and second threaded sleeves 2.80 and 2.79, respectively. In the preferred second embodiment, cover plate 2.78 has a metal bar 2.81 affixed, as by rivets 2.83, to the underside thereof. Metal bar 2.8I has a threaded hole 2.87, in alignment with hole 2.85 through cover plate 2.78, for receipt of threaded sleeve 2.79, and sleeve 2.79 is secured to cover plate 2.78 by threaded hole 2.87 and hex nut 2.82 in a manner that will now be apparent. First threaded sleeve 2.80 is secured to second threaded sleeve 2.79 by an adaptor (or "fixture hickey") 2.89, substantially spherical in shape, having upper and lower threaded holes 2.156 and 2.158, respectively, for receipt of threaded sleeves 2.79 and 2.80. Threaded sleeve 2.80 passes through hole 2.84 in canopy cover 2.76 and is then secured to canopy cover 2.76 by threaded hanger 2.86, which supports lighting fixture L, partially shown. Cover plate 2.78, constructed of a suitably strong non-conductor material and preferably fabricated as a well-known "printed circuit" board, has a second set of contacts, preferably concentric rings 2.88 shown in FIG. 15, laminated to the upper surface thereof as shown, mounted for receipt of electricity from the first set of contacts 2.68 when the light fixture is in the raised position, adjacent the ceiling. Together, the first set and second set of contacts, 2.68 and 2.88, are seen to comprise contact means for supplying electrical power to the light fixture when the light fixture is in the raised position. The circular symmetry of contacts 2.88 will be understood to allow proper contact between contacts 2.68 and 2.88 for any rotational orientation of canopy junction box 2.56 with respect to ceiling junction box 2.52. Wires 2.92 attach to contacts 2.88 preferably by means of slide-on fasteners 2.95 which connect to terminals or clips 2.94 which are riveted to contacts 2.88 by rivets 2.91. Wires 2.92 also pass through holes 2.98 in adaptor 2.89 and through a hole, not shown, in threaded hanger 2.86, and attach to lamps, not shown, in light fixture L, in the usual manner. It shall be understood that, alternatively, adaptor 2.89 could be omitted, causing threaded sleeve 2.80 to include sleeve 2.79, and having holes drilled therethrough for wires 2.92 as in the first embodiment. If desired, a grounding terminal 2.97 may be riveted to metal bar 2.81 using one of rivets 2.83, for connection to lamp fixture L in a manner well known to those skilled in the art.

In the preferred second embodiment, shown in FIG. 12, means are provided, such as peripheral edge 2.100 of canopy cover 2.76, extending toward ceiling surface S, for covering contact means, such as first and second set of contacts 2.68 and 2.88, from substantial access when the light fixture is in the raised position as shown in FIG. 12, as now will be understood by those skilled in the art.

Referring to FIG. 12, ceiling junction box 2.52 may additionally comprise limit switch means, preferably such as normally closed plunger type switches 2.102, interconnected with power control means 2.160 in a manner hereinafter described, so as to remove power from light fixture L when canopy junction box is not in the raised position, and also in a manner so as to remove power from motor 2.34 as canopy junction box 2.56 enters the raised position, thereby preventing canopy junction box from being hoisted past the raised position. Plunger switches 2.102, attached to ceiling junction box body 2.58 by nuts 2.101, are positioned with actuating plungers 2.104 extending downwardly for contact with actuating plate 2.105, shown in FIGS. 11 and 12. Actuating plate 2.105, shown in FIG. 17 and preferably constructed of a rigid insulating material such as synthetic plastic resin sold under the trademark PLEXIGLAS, has a hole 2.107 in the center thereof for the passage therethrough of cable 2.24, allowing plate 2.105 to freely move up and down relative to cable 2.24. Hole 2.107, while larger than cable 2.24, is smaller than the outer diameter of threaded sleeve 2.79. It will now be apparent that plate 2.105 is urged upwardly by sleeve 2.79 as the light fixture L enters the raised position adjacent the ceiling, see FIG. 12. As actuating plate 2.105 is urged upwardly by threaded sleeve 2.79, plate 2.105 contacts plungers 2.104, thereby opening limit switches 2.102 which appropriately control power to lighting fixture L and motor 2.34 in a manner hereinafter described. Although only one of switches 2.102 is required, as the two switches 2.102 are wired in series and are actuated substantially together, two are preferably provided for balanced and symmetrical contacting actuation with plate 2.105 and for safety in case one switch seizes in the close position. Conversely, as light fixture L leaves the raised position, the flow of electricity from the source of electrical power to first set of contacts 2.68 is interrupted, in a manner hereinafter described, as plunger switches 2.102 assume the normally closed condition when plungers 2.104 are allowed to proceed downwardly when threaded sleeve 2.79 stops urging plate 2.105 upward against plungers 2.104. In this manner, when light fixture L is not in the raised position, and contacts 2.68 are exposed for access, electrical power is removed from contacts 2.68, in a manner hereinafter described, providing greater safety to a maintenance worker. Obviously, other appropriate safety and limit switch means could be equivalently provided to remove power from contacts 2.68 when they are exposed for access, in a manner that will now be apparent to those skilled in the art, without departing from the scope of the present invention.

Referring to FIG. 12 and 15, hoist cable 2.24 is seen to allow raising and lowering of light fixture L, preferably by attachment to canopy junction box 2.56 using attachment means such as anchor or ferrule 2.108 secured to threaded sleeve 2.79 by securing means such as a press-fit pin 2.110 inserted through hole 2.114 drilled transversely through threaded sleeve 2.79 and ferrule 2.108. Hoist cable 2.24 is securely fastened to anchor 2.108 by means well known to those skilled in the art, such as by being crimped or welded within a portion of anchor 2.108.

Hoist cable 2.24 and anchor 2.108 are seen to pass through hole 2.118 of ceiling junction box cover plate 2.60, with hoist cable 2.24 continuing to pass through hole 2.107 in actuating plate 2.105, then through tube 2.57 and through base 2.26. Cable 2.24 then passes over cable guide 2.122, preferably a pulley as shown, and on to take-up shaft 2.46 of hoist mechanism 2.22, where it is secured for winding into windings 2.124 on winch means 2.45. Referring to FIG. 10 and 12, pulley 2.122, preferably attached to base 2.26 using means well known to those skilled in the art, such as screws 2.125, nuts 2.121, and standoffs 2.127, guides cable 2.24 emerging from the upper end of tube 2.57 onto take-up shaft 2.46. Standoffs 2.127 provide clearance between pulley housing 2.123 and base 2.26 for conduit connector 2.150. As hoist cable 2.24 winds and unwinds on take-up shaft 2.46, light fixture L is raised and lowered, traveling from a raised position adjacent ceiling C, as shown in FIG. 12, to a lowered position, not shown, distant from the ceiling, for cleaning, maintenance, and changing of bulbs.

Figure 20:
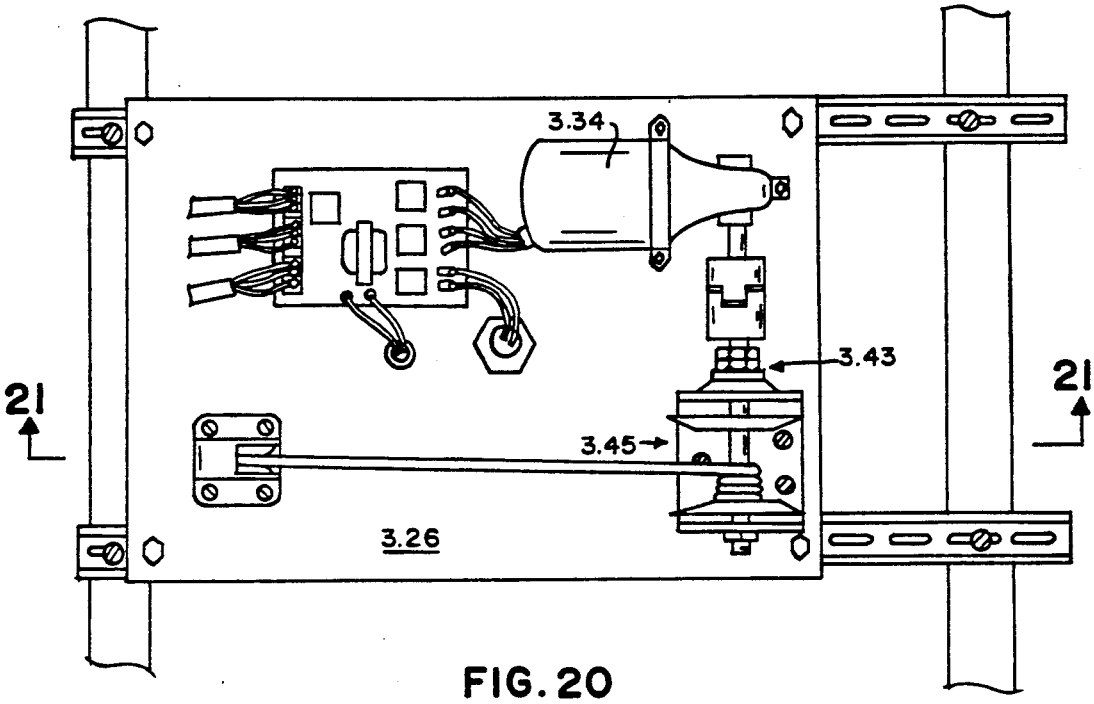
FIG. 20 is a top plan view of the third embodiment of the present invention, shown mounted on top of a pair of ceiling joists.
Figure 21:
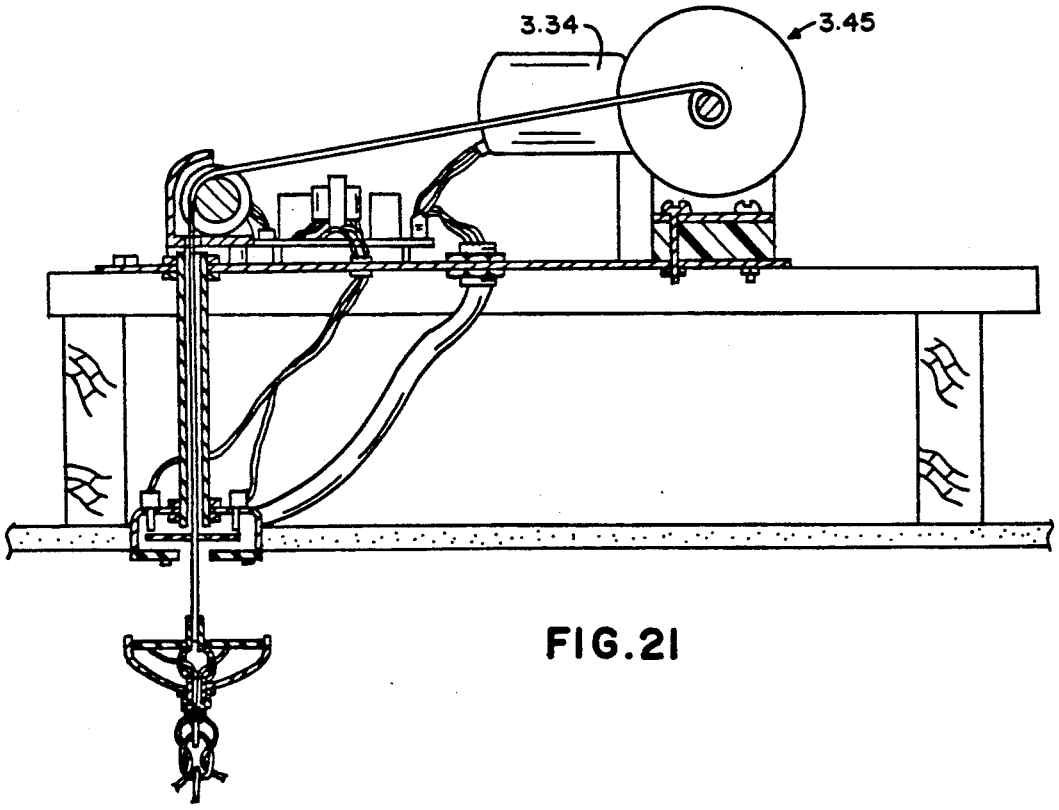
FIG. 21 is a front sectional view of the third embodiment, taken substantially along the lines 21—21 shown in FIG. 20.

FIGS. 20 and 21 show the third preferred embodiment, substantially similar to the second embodiment, and with identifying reference designators marked similarly to the second embodiment, except with the prefix "3.". The operation and all parts are similar to the second embodiment except that winch means 3.45, rather than having gear means as in the second embodiment (see 2.47 in FIG. 10), instead is a direct drive winch means, still with braking means 3.43 similar to that described in the second embodiment. A suitable winch means for this purpose is the Model K650 winch, manufactured by Fulton Performance Products, P. O. Box 19903, Milwaukee, Wis. 53219. Again, it will be noted that, by re-arrangement of parts, a motor without a right-angle drive shaft (i.e., one with an output shaft as in the first preferred embodiment) could be used, with an appropriate sacrifice of the density of the items on base 3.26, without departing from the spirit and scope of the present invention.

A fourth embodiment is similar to the second an third embodiments, but instead omits braking means 3.43 from winch means 3.45, and uses a motor 3.34 with self-contained braking means. A suitable motor for this purpose is the Model V80320AA33 gearmotor with optional brake, manufactured by the Von Weis Gear Company, St. Louis, Mo. A suitable winch means for this purpose may be made by The Chantland Company, P. O. Drawer A, Humboldt, Iowa 50548.

Figure 22:
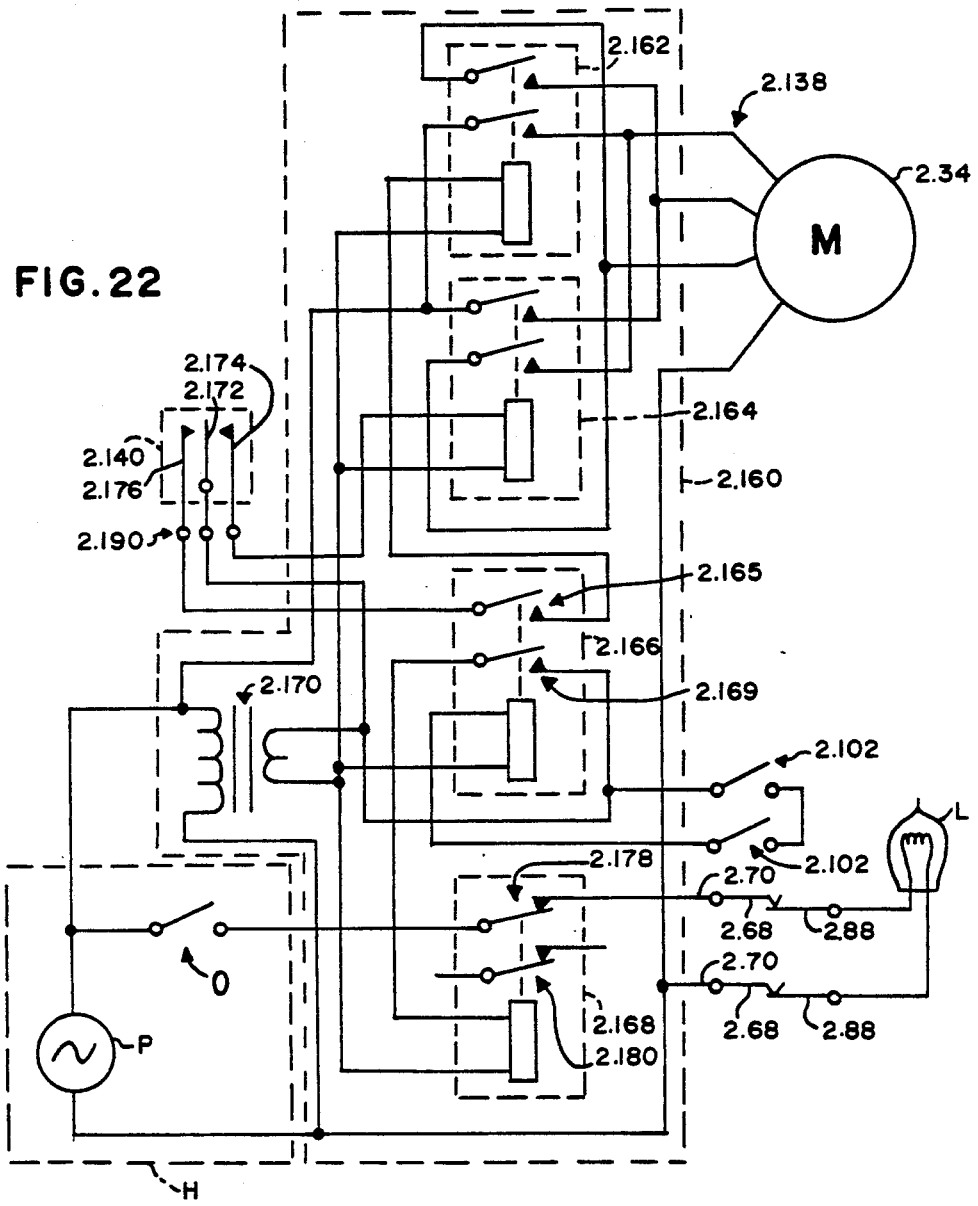
FIG. 22 is a schematic diagram showing the wiring interconnections for the second, third, and fourth embodiments.

Referring now to FIG. 22, the details of the preferred wiring interconnection for the second, third, and fourth embodiments are shown. The standard house wiring H, comprising a power source P, typically a 110 Volt AC power source, and an on-off switch 0, supplies electrical power to power control means 2.160. Power control means 2.160 comprises first switching means, such as normally-open "UP" relay 2.162, normally open "DOWN" relay 2.164, and first set of normally-open contacts 2.165 of limit relay 2.166, for applying power to and reversibly controlling motor 2.34, as well as second switching means, such as normally-closed lamp power relay 2.168 and second set of normally-open contacts 2.169 of limit relay 2.166, for applying power to and removing power from light fixture L. It should be noted that relays 2.162, 2.164, 2.166, and 2.168 all preferably have coil energizing voltages of 24 Volts AC, being driven by step-down transformer 2.170, well known to those skilled in the art, having a primary winding voltage of 110 Volts AC, selected for compatibility with power source P, and having a secondary winding voltage of 24 Volts AC, selected for compatibility with the coil energizing voltages of relays 2.162, 2.164, 2.166, and 2.168.

When wall switch 2.140, similar to wall switch 140 previously described, is in the center or "OFF" position, neither of relays 2.162 or 2.164 are energized. When switch 2.140 is thrown in the "DOWN" position, contacts 2.172 and 2.174 are connected to each other, thereby energizing "DOWN" relay 2.164 (but not "UP" relay 2.162), applying power to the windings of motor 2.34 and causing it to turn in one direction in a manner well known to those skilled in the art.

When light fixture L is not in the raised position, i.e., lowered a distance from the ceiling surface S, normally-closed limit switches 2.102 are both closed because actuating plate 2.105 is not causing switches 2.102 to be actuated, as previously described. This closing of switches 2.102 energizes limit relay 2.166, closing contacts 2.165 and 2.169. When contacts 2.169 are closed, lamp power relay 2.168 is energized, opening first and second set of normally-closed contacts 2.178 and 2.180, respectively, on relay 2.168, thereby removing power from contacts 2.68, thereby providing safety for a maintenance worker who might accidentally come in contact with them.

In contrast, when light fixture L is in the raised position, switches 2.102 are opened by plate 2.105, causing limit relay 2.166 to not be energized, opening contacts 2.165 and 2.169. When contacts 2.165 are opened, the throwing of switch 2.140 in the "UP" position, connecting contacts 2.172 and 2.176 to each other, has no effect, as open contacts 2.165 prevent "UP" relay 2.162 from being energized, thereby preventing the light fixture from being hoisted past the raised position adjacent the ceiling surface S. Similarly, when contacts 2.169 are opened, again, only happening when light fixture L is in the raised position, lamp power relay 2.168 is caused not to be energized, closing normally-open contacts 2.178 and 2.180, thereby applying power to contacts 2.68, rings 2.88, and light L.

Now, when wall switch 2.140 is thrown in the "UP" position, causing contacts 2.172 and 2.176 to be connected to each other, if the light fixture L is not in the raised position so that contacts 2.165 are closed as previously described, "UP" relay 2.162 will be energized, applying power to motor 2.34 in a manner to cause the motor to rotate in a direction opposite that when "DOWN" relay 2.164 was energized, due to the permuted interconnection of the wires 2.138 to motor 2.34, as will be understood by those skilled in the art. When the light fixture L enters the raised position, adjacent the surface S of the ceiling C, switches 2.102 will become opened, applying power to the light fixture L through contacts 2.68, and removing power from motor 2.34 by de-energizing "UP" relay 2.162, in a manner previously described.

In practice, a maintenance worker would operate wall box key switch 2.140, causing motor 2.34 to lower light fixture L for maintenance. As light fixture L leaves the raised position, plunger switch 2.102 removes power from first set of contacts 2.68 as they become exposed for access, the light fixture descends further to a lowered position distant from the ceiling, allowing maintenance, and the key switch is returned to the "off" position. After maintenance is completed, key switch 2.140 is placed in the "up" position, causing motor 2.34 to raise light fixture L toward the ceiling. As light fixture L enters the raised position, switch 2.102 is actuated, restoring power to first set of contacts 2.68, restoring electricity to light fixture L. Also, as light fixture L enters the raised position, power is interrupted to drive motor 2.34, preventing light fixture L from being raised past the raised position adjacent the ceiling. Light fixture L will remain in the raised position until key switch 2.140 is again turned to the "down" position, repeating the lowering process.

As a variation on the present invention, a third pair of contacts 2.68 and 2.88 could be provided on cover plates 2.60 and 2.78, respectively, connected through presently unused contacts 2.180 on relay 2.168 to another on-off switch, not shown, in house wiring H, for operating another electrical device on light fixture L such as a second light or a ceiling fan.

Figure 23:
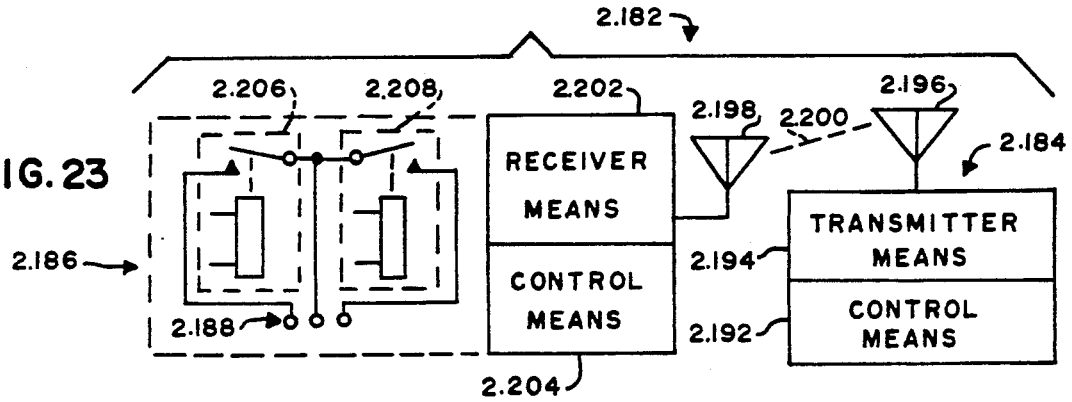
FIG. 23 is a diagram showing the wireless remote control means of the present invention.

If desired, for any of the embodiments, a wireless remote control means, preferably such as shown in FIG. 23, may be used in place of wall box key switch 2.140. Remote control means 2.182, well known to those skilled in the art, comprises a transmitter portion 2.184 and a receiver portion 2.186, with receiver portion preferably mounted on base 2.26 and connected, at terminals 2.188, in place of wall box key switch 2.140 at terminals 2.190. Transmitter portion 2.184 comprises transmitter control means 2.192, well-known to those skilled in the art, with an "UP" button and a "DOWN" button, not shown, for causing transmitter means 2.194 to transmit a certain radio signal 2.200 from antenna 2.196 to antenna 2.198 of receiver portion 2.186. Receiver portion 2.186 receives the radio signal 2.200 using receiver means 2.202, well-known to those skilled in the art, and causes receiver control means 2.204, responsive to receiver means 2.202, to actuate switching means 2.206 or 2.208, alternately, depending on whether the "UP" or "DOWN" button was pressed on transmitter control means 2.192, in a manner well-known to those skilled in the art. It will now be understood that, acting together, switching means 2.206 and 2.208 perform the same function as did contacts 2.176, 2.172, and 2.174 of wall switch 2.140. It also be understood that, rather than employing a radio signal 2.200 to convey the desired "UP" or "DOWN" movement of light fixture L, an infrared transmitter and receiver, well known to those skilled in the art, could be used instead, passing an infrared signal between the transmitter and the receiver. In such a case, as is well known to those skilled in the art, an infrared transmitting means would replace transmitting antenna 2.196 and transmitting means 2.194, while an infrared detector and receiving means would replace receiving antenna 2.198 and radio receiver means 2.202. Obviously, in such a variation of the present invention, it would be necessary to place the infrared detector on a surface of the room in which the infrared transmitter would be used.

Although the present invention has been described and illustrated with respect to preferred embodiments and a preferred use therefor, it is not to be so limited since modifications and changes can be made therein which are within the full intended scope of the invention.

We claim:

1. A motorized light fixture lift system, comprising:

a. a hoist mechanism for raising and lowering a light fixture between a raised position adjacent a ceiling and a lowered position distant from the ceiling, said hoist mechanism comprising:

i. a base for mounting above the ceiling;

ii. a drive motor mounted upon the base, said drive motor including a drive shaft; and, iii. a take-up shaft directly coupled to the drive shaft;

b. a ceiling junction box attached to the ceiling comprising a first set of contacts for supplying a source of electrical power to the light fixture;

c. a canopy junction box attached to the light fixture comprising a second set of contacts mounted for receipt of electricity from the first set of contacts when the light fixture is in the raised position; and, d. a single hoist cable attached at one end to the take-up shaft for being wound upon said take-up shaft and attached at the other end to the canopy junction box.

2. The apparatus as recited in claim 1, wherein the canopy junction box prevents access to the first and second set of contacts when the light fixture is in the raised position.

3. The apparatus as recited in claim 1, wherein the ceiling comprises a first joist and a second joist, said first joist spaced apart from said second joist, and further wherein the base is attached to said first and second joists with the hoist cable passing between said first and second joists.

4. The apparatus as recited in claim 1, wherein the hoist mechanism additionally comprises a cable guide attached to the base for applying tension to the hoist cable, as it is wound upon the take-up shaft, by guiding the hoist cable at an angle not greater than ninety degrees with respect to the take-up shaft.

5. The apparatus as recited in claim 4, wherein the cable guide comprises a notch for receipt of the hoist cable.

6. The apparatus as recited in claim 1, wherein the ceiling junction box further comprises a limit switch interposed between the drive motor and a power source, said limit switch being normally closed when the light fixture is not in the raised position, said limit switch further being positioned for interruption of the flow of power to the drive motor as the light fixture enters the raised position.

7. The apparatus as recited in claim 1, wherein the ceiling junction box further comprises a safety switch interposed between the source of electrical power and the first set of contacts, said safety switch being normally open when the light fixture is not in the raised position, said safety switch further being positioned for interruption of the flow of electricity to the first set of contacts as the light fixture leaves the raised position.

8. The apparatus as recited in claim 1, wherein at least one set of said first and second set of contacts is magnetized for attraction to the other set of contacts.

9. The apparatus as recited in claim 8, wherein the hoist mechanism additionally comprises a cable guide attached to the base for applying tension to the hoist cable, as it is wound upon the take-up shaft, by guiding the hoist cable at an angle not greater than ninety degrees with respect to the take-up shaft, and wherein the ceiling junction box further comprises:

a. a limit switch interposed between the drive motor and a power source, said limit switch being normally closed when the light fixture is not in the raised position, said limit switch further being positioned for interruption of the flow of power to the drive motor as the light fixture enters the raised position; and, b. a safety switch interposed between the source of electrical power and the first set of contacts, said safety switch being normally open when the light fixture is not in the raised position, said safety switch further being positioned for interruption of the flow of electricity to the first set of contacts as the light fixture leaves the raised position.

10. In combination with a light fixture, a motorized light fixture lift system comprising:

a. a hoist mechanism for raising and lowering said light fixture between a raised position adjacent a ceiling and a lowered position distant from the ceiling, said hoist mechanism comprising:
   i. a base for mounting above the ceiling;
   ii. a drive motor mounted upon the base, said drive motor including a drive shaft; and,
   iii. a take-up shaft directly coupled to the drive shaft;

b. a ceiling junction box attached to the ceiling comprising a first set of contacts for supplying a source of electrical power to the light fixture;

c. a canopy junction box attached to the light fixture comprising a second set of contacts mounted for receipt of electricity from the first set of contacts when the light fixture is in the raised position; and, d. a single hoist cable attached at one end to the take-up shaft for being wound upon said take-up shaft and attached at the other end to the canopy junction box.

11. The apparatus as recited in claim 10, wherein the canopy junction box prevents access to the first and second set of contacts when the light fixture is in the raised position.

12. The apparatus as recited in claim 10, wherein the ceiling comprises a first joist and a second joist, said first joist spaced apart from said second joist, and further wherein the base is attached to said first and second joists with the hoist cable passing between said first and second joists.

13. The apparatus as recited in claim 10, wherein the hoist mechanism additionally comprises a cable guide attached to the base for applying tension to the hoist cable, as it is wound upon the take-up shaft, by guiding the hoist cable at an angle not greater than ninety degrees with respect to the take-up shaft.

14. The apparatus as recited in claim 13, wherein the cable guide comprises a notch for receipt of the hoist cable.

15. The apparatus as recited in claim 10, wherein the ceiling junction box further comprises a limit switch interposed between the drive motor and a power source, said limit switch being normally closed when the light fixture is not in the raised position, said limit switch further being positioned for interruption of the flow of power to the drive motor as the light fixture enters the raised position.

16. The apparatus as recited in claim 10, wherein the ceiling junction box further comprises a safety switch interposed between the source of electrical power and the first set of contacts, said safety switch being normally open when the light fixture is not in the raised position, said safety switch further being positioned for interruption of the flow of electricity to the first set of contacts as the light fixture leaves the raised position.

17. The apparatus as recited in claim 10, wherein at least one set of said first and second set of contacts is magnetized for attraction to the other set of contacts.

18. The apparatus as recited in claim 17, wherein the hoist mechanism additionally comprises a cable guide attached to the base for applying tension to the hoist cable, as it is wound upon the take-up shaft, by guiding the hoist cable at an angle not greater than ninety degrees with respect to the take-up shaft, and wherein the ceiling junction box further comprises:

a. a limit switch interposed between the drive motor and a power source, said limit switch being normally closed when the light fixture is not in the raised position, said limit switch further being positioned for interruption of the flow of power to the drive motor as the light fixture enters the raised position; and, b. a safety switch interposed between the source of electrical power and the first set of contacts, said safety switch being normally open when the light fixture is not in the raised position, said safety switch further being positioned for interruption of the flow of electricity to the first set of contacts as the light fixture leaves the raised position.

19. A motorized light fixture lift system, comprising:

a. a hoist mechanism for raising and lowering a light fixture between a raised position adjacent a ceiling and a lowered position distant from the ceiling, said hoist mechanism comprising:
   i. a base for mounting above the ceiling;
   ii. a drive motor mounted upon the base, said drive motor including a drive shaft; and,
   iii. a take-up shaft coupled to the drive shaft;

b. a ceiling junction box, mounted a fixed distance from the base, comprising a first set of contacts for supplying a source of electrical power to the light fixture;

c. a canopy junction box attached to the light fixture comprising a second set of contacts mounted for receipt of electricity from the first set of contacts when the light fixture is in the raised position; and, d. a single hoist cable attached at one end to the take-up shaft for being wound upon said take-up shaft and attached at the other end to the canopy junction box.

20. A motorized light fixture lift system, comprising:

a. a single hoist cable;

b. a hoist mechanism for raising and lowering a light fixture between a raised position adjacent a ceiling and a lowered position distant from the ceiling, said hoist mechanism comprising:

i. a base for mounting above the ceiling;

ii. a drive motor mounted upon the base, said drive motor including a drive shaft; and, iii. winch means for winding and unwinding the hoist cable, said winch means including a take-up shaft coupled to the drive shaft and attached to one end of the hoist cable for winding and unwinding the hoist cable;

c. a ceiling junction box, mounted a fixed distance from the base, comprising a first set of contacts for supplying a source of electrical power to the light fixture;

d. a canopy junction box attached to the light fixture and to the other end of the hoist cable, said canopy junction box comprising a second set of contacts mounted for receipt of electricity from the first set of contacts when the light fixture is in the raised position.

21. The apparatus as recited in claim 20, wherein the canopy junction box prevents access to the first and second set of contacts when the light fixture is in the raised position.

22. The apparatus as recited in claim 20, wherein the hoist mechanism additionally comprises a pulley attached to the base for guiding the hoist cable to the take-up shaft.

23. The apparatus as recited in claim 20, wherein the ceiling junction box further comprises limit switch means for causing the drive motor to be prevented from raising the light fixture above the raised position

24. The apparatus as recited in claim 20, wherein the ceiling junction box further comprises limit switch means for causing the drive motor to be prevented from raising the light fixture above the raised position and for causing electrical power to be removed from the first set of contacts when the light fixture is not in the raised position.

25. The apparatus as recited in claim 20, wherein the hoist mechanism further comprises braking means for preventing the light fixture from descending except as caused by the rotation of the drive shaft.

26. The apparatus as recited in claim 25, in which the braking means is a part of the drive motor.

27. The apparatus as recited in claim 20, in which the winch means further comprises braking means for preventing the light fixture from descending except as caused by the rotation of the drive shaft.

28. The apparatus as recited in claim 20, wherein the apparatus further comprises remote control means for causing the motor to raise and lower the light fixture.

29. A motorized light fixture lift system, comprising:

a. a single hoist cable;

b. a hoist mechanism for raising and lowering a light fixture between a raised position adjacent a ceiling and a lowered position distant from the ceiling, said hoist mechanism comprising:

i. a base for mounting above the ceiling;

ii. a drive motor mounted upon the base, said drive motor including a drive shaft;

iii. winch means for winding and unwinding the hoist cable, said winch means including a take-up shaft coupled to the drive shaft and attached to one end of the hoist cable for winding and unwinding the hoist cable;

iv. a pulley for guiding the hoist cable to the take-up shaft; and, v. braking means for preventing the light fixture from descending except as caused by the rotation of the drive shaft;

c. a ceiling junction box, mounted a fixed distance from the base, comprising:

i. a first set of contacts for supplying a source of electrical power to the light fixture; and, ii. limit switch means for causing the drive motor to be prevented from raising the light fixture above the raised position and for causing electrical power to be removed from the first set of contacts when the light fixture is not in the raised position; and, d. a canopy junction box attached to the light fixture and to the other end of the hoist cable, said canopy junction box comprising a second set of contacts mounted for receipt of electricity from the first set of contacts when the light fixture is in the raised position, and wherein said canopy junction box prevents access to the first and second set of contacts when the light fixture is in the raised position.

30. The apparatus as recited in claim 29, wherein the lift system further comprises remote control means for causing the motor to raise and lower the light fixture.

* * * * *